US010065826B1

(12) United States Patent
Ruiz et al.

(10) Patent No.: US 10,065,826 B1
(45) Date of Patent: Sep. 4, 2018

(54) STACKING MODULE WITH FANS

(71) Applicant: Xerox Corporation, Norwalk, CT (US)

(72) Inventors: Erwin Ruiz, Rochester, NY (US); Ali R. Dergham, Fairport, NY (US); Glenn David Batchelor, Fairport, NY (US); William A. Novak, Pittsford, NY (US); Paul F. Brown, II, Webster, NY (US)

(73) Assignee: Xerox Corporation, Nor, CT (US)

( * ) Notice: Subject to any disclaimer, the term of this patent is extended or adjusted under 35 U.S.C. 154(b) by 0 days.

(21) Appl. No.: 15/669,588

(22) Filed: Aug. 4, 2017

(51) Int. Cl.

| | |
|---|---|
| ***B65H 29/20*** | (2006.01) |
| ***B65H 29/40*** | (2006.01) |
| ***B65H 29/24*** | (2006.01) |
| ***B41J 13/00*** | (2006.01) |
| ***B65H 43/00*** | (2006.01) |
| ***B65H 29/06*** | (2006.01) |
| ***B65H 15/00*** | (2006.01) |
| ***B65H 7/02*** | (2006.01) |
| ***B65H 29/22*** | (2006.01) |

(52) U.S. Cl.
CPC ..... *B65H 29/40* (2013.01); *B41J 13/0045* (2013.01); *B41J 13/0081* (2013.01); *B65H 7/02* (2013.01); *B65H 15/00* (2013.01); *B65H 29/06* (2013.01); *B65H 29/22* (2013.01); *B65H 29/241* (2013.01); *B65H 29/246* (2013.01); *B65H 43/00* (2013.01); *B65H 2301/33214* (2013.01); *B65H 2404/651* (2013.01); *B65H 2404/655* (2013.01)

(58) Field of Classification Search
CPC ..... B65H 15/00; B65H 29/00; B65H 29/20; B65H 29/22; B65H 29/24; B65H 29/241; B65H 29/245; B65H 29/246; B65H 29/38; B65H 29/40; B65H 2404/65; B65H 2404/651; B65H 2404/655
See application file for complete search history.

(56) References Cited

U.S. PATENT DOCUMENTS

| | | | | |
|---|---|---|---|---|
| 5,152,513 | A * | 10/1992 | Ogasawara | B65H 15/00 271/184 |
| 7,712,735 | B2 * | 5/2010 | Chorier-Pichon | B65H 3/124 271/149 |
| 2005/0271448 | A1 * | 12/2005 | Shmaiser | B65H 9/004 400/624 |
| 2007/0056453 | A1 * | 3/2007 | Dinnissen | B65H 29/40 101/232 |
| 2008/0136088 | A1 * | 6/2008 | Dinnissen | B65H 29/40 271/186 |
| 2011/0187038 | A1 * | 8/2011 | Heise | B65H 15/00 271/3.11 |
| 2014/0145395 | A1 * | 5/2014 | Takano | B65H 31/26 271/211 |
| 2014/0210153 | A1 * | 7/2014 | Nagumo | B41J 11/0085 271/5 |

(Continued)

*Primary Examiner* — Prasad V Gokhale

(57) ABSTRACT

An apparatus is disclosed. For example, the apparatus includes a paper feed to feed print media a single sheet at a time, a plurality of rotating discs, wherein each one of the plurality of rotating discs comprises an elastomer ring to secure a leading edge of the single sheet against a registration wall and initiate a flipping process, a plurality of fans to generate an air flow, wherein the air flow levitates a trailing edge of the single sheet during completion of the flipping process, and a movable platform to hold a stack of the print media.

18 Claims, 5 Drawing Sheets

(56) References Cited

U.S. PATENT DOCUMENTS

| | | | | |
|---|---|---|---|---|
| 2014/0246827 | A1* | 9/2014 | Kuypers | B65H 29/40 271/186 |
| 2015/0284209 | A1* | 10/2015 | Bryl | B65H 29/40 414/802 |

* cited by examiner

STACKING MODULE WITH FANS

The present disclosure relates generally to printing devices and, more particularly, to an improved stacking module with fans.

BACKGROUND

Printers are used to print text, images, graphics, and the like on print media. The images are rendered for the printer. The print media is loaded through a print path of the printer to print the desired image onto the print media. The print media may travel through various processing areas in the printer and finishing modules to complete the print job. Different finishing modules may perform post print processing on the print media.

Customers are moving to thinner, lighter, and larger print media to save cost. However, the thinner, lighter, and larger print media can cause malfunctions (e.g., paper jams) in certain modules of the printer. For example, as the print media becomes lighter and larger, the print media may not have enough beam strength or stiffness for certain processing. The thinner and larger print media may also be more prone to wrinkles and ripples in high relative humidity. The wrinkles or ripples in the print media may also cause problems in certain modules in the printer.

SUMMARY

According to aspects illustrated herein, there are provided an apparatus and a method for flipping print media in stacker module. One disclosed feature of the embodiments is an apparatus comprising a paper feed to feed print media a single sheet at a time, a plurality of rotating discs, wherein each one of the plurality of rotating discs comprises an elastomer ring to secure a leading edge of the single sheet against a registration wall and initiate a flipping process, a plurality of fans to generate an air flow, wherein the air flow levitates a trailing edge of the single sheet during completion of the flipping process, and a movable platform to hold a stack of the print media.

Another disclosed feature of the embodiments is a method for flipping print media in a stacker module. In one embodiment, the method activates a paper feed to feed a single sheet of the print media in a stacker module, initiates a rotation of a plurality of rotating discs each having an elastomer ring to catch the single sheet of the print media to initiate a flipping process, detects a leading edge of the sheet of paper against a registration wall, and activates a plurality of fans to generate an air flow to levitate a trailing edge of the single sheet during completion of the flipping process.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses an improved stacking module with fans. As discussed above, as customers desire to use thinner, lighter, and larger print media to save cost, the thinner, lighter, and larger print media can cause problems in certain modules of the printer. One example module is a stacking module that is used to flip and stack the print media. For example, as the print media becomes lighter and larger, the print media may not have enough beam strength or stiffness to flip on its own. As a result, print media may collapse on itself during the flipping process and create a jam in the stacking module. The thinner and larger print media may also be more prone to wrinkles and ripples in high relative humidity that can cause the stacker module to operate incorrectly or jam.

Embodiments of the present disclosure provide an improved stacking module that uses fans to provide air that can partially levitate the print media to allow the print media to complete the flipping process in the stacking module. The air generated by the fans may support the print media and prevent the print media from collapsing during the flipping process. As a result, lighter, thinner and larger print media may be used, even in relatively high humidity, without jamming the stacker module or causing the stacker module to malfunction.

Figure 1:
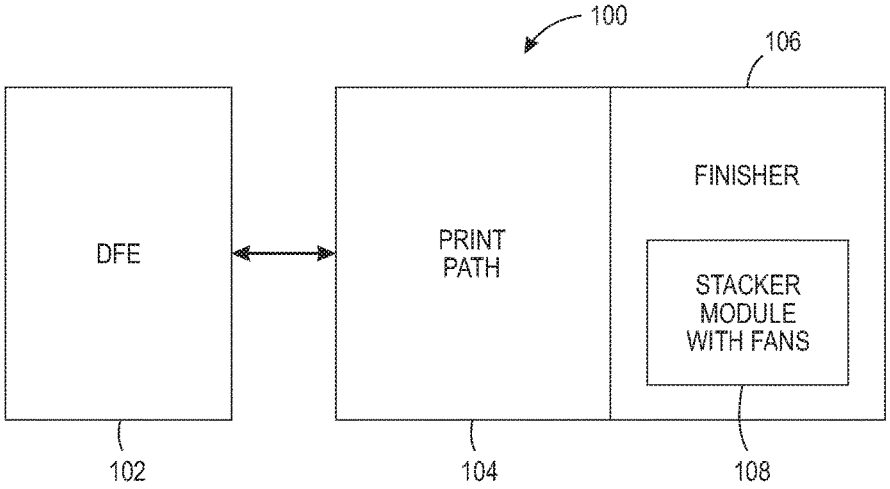
FIG. 1 illustrates a block diagram of an example printing device of the present disclosure.

FIG. 1 illustrates an example printer 100 that includes a stacker module 108 with fans (also referred to simply as the stacker module 108) of the present disclosure. FIG. 1 illustrates a block diagram of the printer 100. In one example, the printer 100 may include a digital front end (DFE) 102. The DFE 102 may include a processor and a memory (e.g., a non-statutory computer readable medium). The processor of the DFE 102 may be in communication with to control operations of components within a print path 104 and a finisher 106. The DFE 102 may process images and documents contained in print job requests to prepare the images or documents to be printed by the printer 100.

In one example, the print path 104 may include printing components such as toner, ink, a fuser, and the like (not shown), that perform the printing operations. The finisher 106 may include various different modules to perform finishing operations such as stapling, collating, stacking, and the like. In one example, the stacker module 108 may perform a flipping process and a stacking process.

It should be noted that FIG. 1 has been simplified for the ease of explanation of the present disclosure. The printer 100 may include additional components not shown in FIG. 1. For example, the printer 100 may include a user interface, networking components, additional paper trays, ink cartridges or toner cartridges, optical components (e.g., an optical scanner), and the like.

Figure 2:
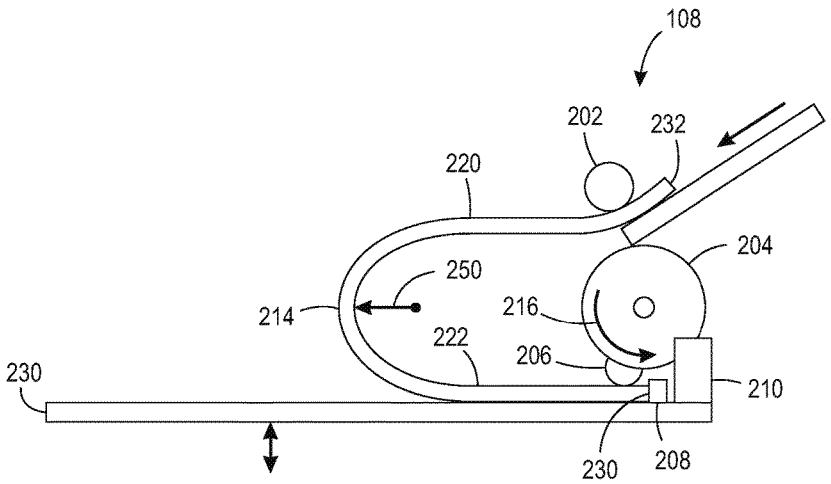
FIG. 2 illustrates a block diagram of side view of an example stacker module with fans of the present disclosure.

FIG. 2 illustrates a side view block diagram of an example of the stacker module 108. In one embodiment, a paper feed 202 may feed a single sheet 214 of print media at a time to the stacker module 108. The paper feed 202 may comprise a platform and a roller that moves the single sheet 214 of the print media into the stacker module 108.

As the single sheet 214 is fed into the stacker module 108 a plurality of discs (or rotating discs) 204 may catch a leading edge 230 of the single sheet 214. For example, each one of the plurality of discs 204 may have an elastomer ring 206 coupled to a camshaft near an outer edge, or circumference, of each one of the plurality of discs 204. The elastomer ring 206 may extend beyond the outer edge or a portion of the outer edge and provide a surface that can "grip" the single sheet 214 as the plurality of discs 204 rotate, as shown by an arrow 216. In one embodiment, the plurality of discs 204 may rotate 180 degrees in a clockwise and/or a counterclockwise direction. The rotation and movement of the plurality of discs 204 may cause the leading edge 230 to move towards the plurality of discs 204.

In one embodiment, the plurality of discs 204 may pull the leading edge 230 of the single sheet 214 towards a registration wall 208. The rotational force applied by the plurality of discs 204 may initiate a flipping process on the single sheet 214 of the print media as a trail edge 232 of the single sheet 214 is ejected from the paper feed 202. The flipping process may flip the single sheet 214 along a length of the single sheet 214 onto the top of a stack of sheets.

In other words, the single sheet 214 may enter the stacker module with a first side facing up. After the flipping process is completed, the first side of the single sheet 214 may be in the same orientation, e.g., facing up, and now be the top sheet in the stack In previously designed stacker modules, the weight of the print media would be sufficient to flip the print media. However, as customers demand that the stacker modules be able to handle longer, thinner, and lighter print media, the currently designed stacker modules may not be able to handle the longer, thinner, and lighter print media. For example, longer, thinner, and lighter print media may not have enough beam strength or stiffness to flip on its own. As a result, the longer, thinner, and lighter print media may collapse without completing the flipping process. As a result, as subsequent sheets of print media enter the previously designed stacker module, a jam may occur as the longer, thinner, and lighter print media is unable to complete the flipping process.

In addition, the thinner and lighter the print media, the more adversely high relative humidity can affect the print media. For example, high relative humidity can cause wrinkles in the print media, which can lead to additional jams in the stacker module 108.

In one example, the single sheet 214 may be a longer, thinner and lighter print media. For example, the single sheet 214 of the print media of the present disclosure may a weight that is less than 50 grams per square meter (gsm) and a length of less than 20 inches. In one example, the length may be greater than 17 inches and less than 20 inches. The length may be defined as a longest dimension of the single sheet 214 of the print media.

In one embodiment, a fan 210 may be installed in the stacker module 108. The fan 210 may generate air flow that helps to levitate a portion 220 of the single sheet 214 that is near the trail edge 232. In one embodiment, the portion 220 may be defined as the half of the single sheet 214 that is closer to the trail edge 232. Levitation of the portion 220 may increase a flipping radius 250. The larger the flipping radius 250, the more robust the flipping process may be against imperfections of the single sheet 214 of the print media (e.g., low beam strength, insufficient stiffness, wrinkles due to high relative humidity, formation of "dog ears, and the like).

Thus, the air flow may prevent the portion 220 from collapsing on top of a portion 222 that is near the leading edge 230 and resting on a movable platform 212. In one embodiment, the portion 222 may be defined as the half of the single sheet 214 that is closer to the lead edge 230. The air flow may help the single sheet 214 that is relatively long and light to complete the flipping process without collapsing on itself.

Figure 3:
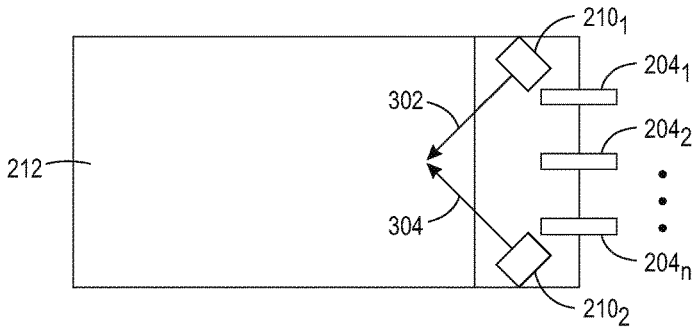
FIG. 3 illustrates a block diagram of a top view of the example stacker module with fans of the present disclosure.
Figure 4:
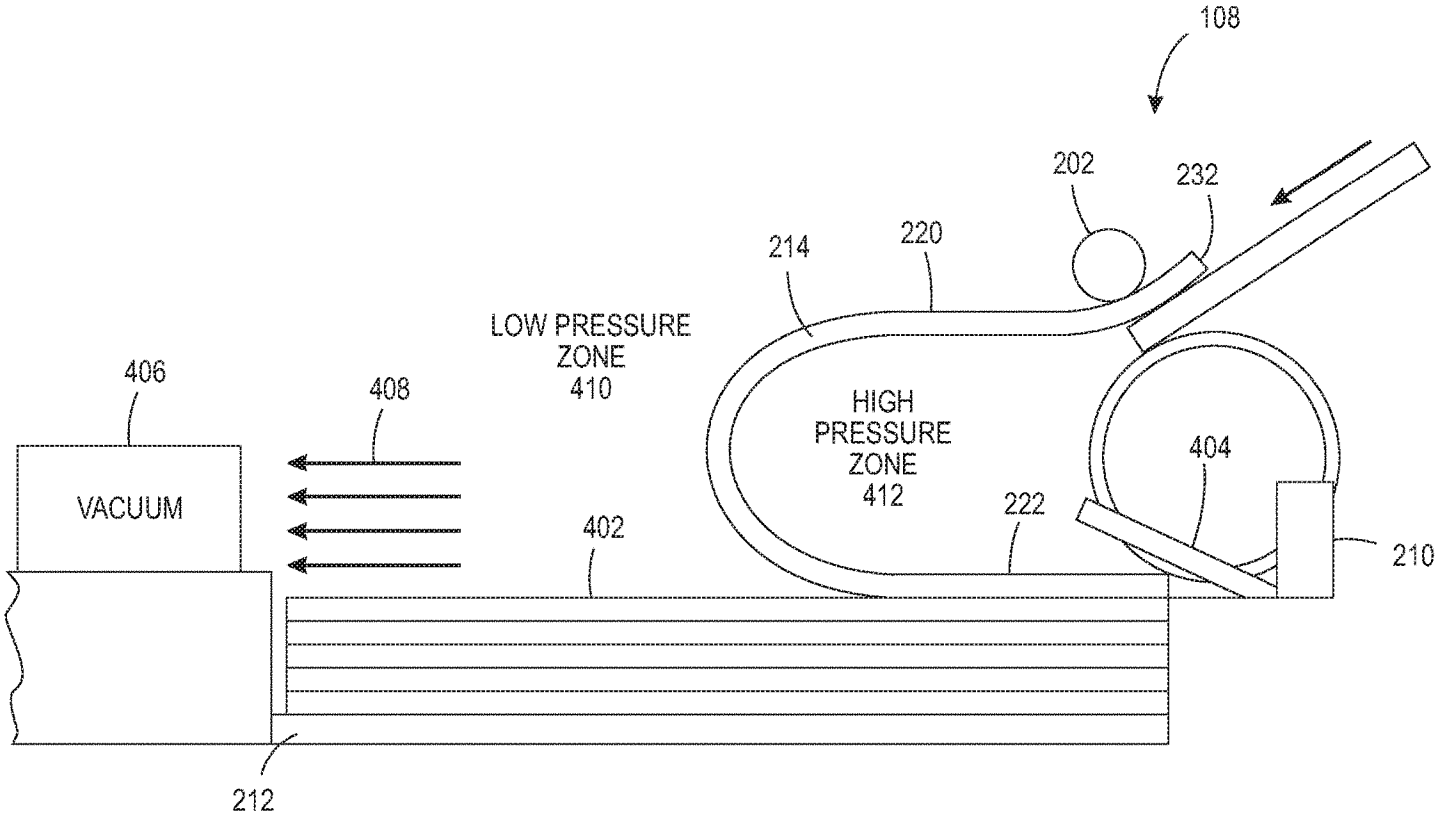
FIG. 4 illustrates a block diagram of a second example stacker module with fans of the present disclosure.

In one embodiment, the amount of air flow generated by the fan 210 may be a function of a weight and a length of the single sheet 214 of the print media. In one embodiment, where there aremultiple fans 210 as illustrated in FIGS. 3 and 4 below, the amount of air flow that is generated may be the total, or combined, air flow generated by both fans 210. For example, the lighter and longer the single sheet 214 is, the more amount of air flow that should be generated. Once the stacker module 108 begins operation and the proper amount of air flow is generated by the fan 210, the fan 210 may remain on until the stacking module 108 completes the stacking operation.

In one embodiment, for the single sheet 214 that has a weight of approximately 45 gsm and a length of 17 inches, the amount of air flow that is generated may be approximately 15-30 cubic feet per minute (cfm). In one embodiment, the amount of air flow generated by the fan 210 may be approximately 25 cfm.

In one embodiment, the fan 210 may be a micro fan. For example, the fan 210 may have dimensions that are smaller than a diameter of each one of the plurality of discs 204. In one embodiment, the fan 210 may be positioned adjacent to the plurality of discs 204 on outer ends of the plurality of discs 204. The fan 210 may be positioned to generate air flow that moves away from the plurality of discs 204 towards an opposite end of the stacker module 108.

FIG. 3 illustrates a block diagram of a top view of the stacker module 108. The top view illustrates the movable platform 212, the plurality of discs $\mathbf{204}_1$ to $\mathbf{204}_n$ and a plurality of fans $\mathbf{210}_1$ and $\mathbf{210}_2$. In one embodiment, two fans $\mathbf{210}_1$ and $\mathbf{210}_2$ may be positioned adjacent to opposite ends of the plurality of discs 204.

In one embodiment, the fans $\mathbf{210}_1$ and $\mathbf{210}_2$ may be angled towards a center of the movable platform 212 to form a "V" formation as illustrated by lines 302 and 304. In other words, the air flow generated by the fans $\mathbf{210}_1$ and $\mathbf{210}_2$ may be angled such that the air flows intersect near a center line of the movable platform 212. The fans $\mathbf{210}_1$ and $\mathbf{210}_2$ may be positioned to provide symmetric air flow across a width of the single sheet 214. In other words, the air flow may be directed from the fans $\mathbf{210}_1$ and $\mathbf{210}_2$ such that the portion 220 is levitated as evenly as possible across the width of the single sheet 214.

FIG. 4 illustrates a block diagram of a second example of the stacker module 108. In one embodiment, the stacker module 108 may include a deflector 404 coupled to at least one fan 210. For example, the fan $\mathbf{210}_1$ and $\mathbf{210}_2$ may each have the deflector 404 or the deflector 404 may be coupled to only one fan $\mathbf{210}_2$ (e.g., the fan on outboard side). In one example, the deflector 404 may be a square or a rectangular piece of metal or plastic that is coupled to a bottom of the fan 210 and angled in a same direction that the fan 210 is angled. The deflector 404 may also be angled upwards away from the movable platform 212. In other words, the deflector 404 may be angled in an upward direction such that air flow generated by the fan moves towards the portion 220 and away from the portion 222 of the single sheet 214.

The deflector 404 may have a width that is approximately the same as a width of the fan 210. The deflector 404 may have a length (e.g., 2-5 inches) that is sufficient to re-direct air flow towards the single sheet 214 and away from an existing stack 402 of print media on the movable platform 212, while not inhibiting the single sheet 214 from resting flat on the existing stack 402.

For example, the movable platform 212 may move down as each sheet 214 of the print media is flipped and stacked on top of one another. The deflector 404 may prevent the air flow generated by the fan 210 from affecting the existing stack 402. For example, without the deflectors 404, the air flow generated by the fan 210 may move sheets of print media in the existing stack 402 causing the existing stack 402 to lose its uniformity. In other words, the deflectors 404 may allow the existing stack 402 to remain uniform during operation of the fan 210 to help the single sheet 214 to complete the flipping process.

In one embodiment, the stacking module 108 may also include a vacuum 406. The vacuum 406 may be coupled on a same horizontal plane as the fans 210 and located on a side that is opposite the fans 210.

The vacuum 406 may suck air towards the vacuum 406 as shown by arrows 408. The vacuum 406 may create a low pressure zone 410 on one side of the single sheet 214. The air flow generated by the fan may create a high pressure zone 412 on an opposite side of single sheet 214. In other words, the single sheet 214 may be a divider between the low pressure zone 410 and the high pressure zone 412.

The vacuum 406 may help the flipping process to complete faster by increasing the speed at which the single sheet 214 may settle on top of the existing stack 402. For example, due to the difference in pressure between the low pressure zone 410 and the high pressure zone 412, the pressure from the high pressure zone 412 may force the portion 220 of the single sheet 214 to flip faster. In addition, the portion 220 of the single sheet 214 may settle faster with less resistance in the low pressure zone 410.

In one embodiment, the processor of the printer 100 (e.g., a controller or processor in the DFE 102) may be in communication with the paper feed 202, the plurality of discs 204, the registration wall 208, the fan 210, the movable platform 212, and the vacuum 406. Thus, the processor may coordinate operation of the paper feed 202, the plurality of discs 204, the registration wall 208, the fan 210, the movable platform 212, and the vacuum 406 to perform the flipping process and stacking process.

For example, when the leading edge 230 is determine to contact the registration wall 208, the registration wall 208 may send a signal to the processor. In response, the processor may activate the fan 210 to levitate the portion 220 of the single sheet 214. After the single sheet 214 is flipped, the subsequent single sheet 214 may be fed until all of the print media is stacked. After all of the print media is stacked the fan 210 may be deactivated.

In one embodiment, a sensor may be located in the stacker module 108 along the paper path to calculate when the leading edge 230 contacts the registration wall 208 or when the trail edge 232 exits the paper feed 202. A distance between the registration wall 208 and the sensor and a speed that the single sheet 214 is moving may be known. Based on the distance and the speed the processor may calculate when the leading edge 230 will contact the registration wall 208 and when the trail edge 232 exits the paper feed 202.

In some embodiments, a user may enter the length and weight of the print media that is being used before printing. Based on the length and the weight of the print media, the processor may determine whether operation of the fan 210 is necessary. In some instances, thresholds may be stored in memory to determine automatically when the fan 210 should be operated. For example, if the length and weight of the print media is above a length threshold and/or a weight threshold, the processor may initiated operation of the fan 210 during the flipping process in the stacker module 108.

Figure 5:
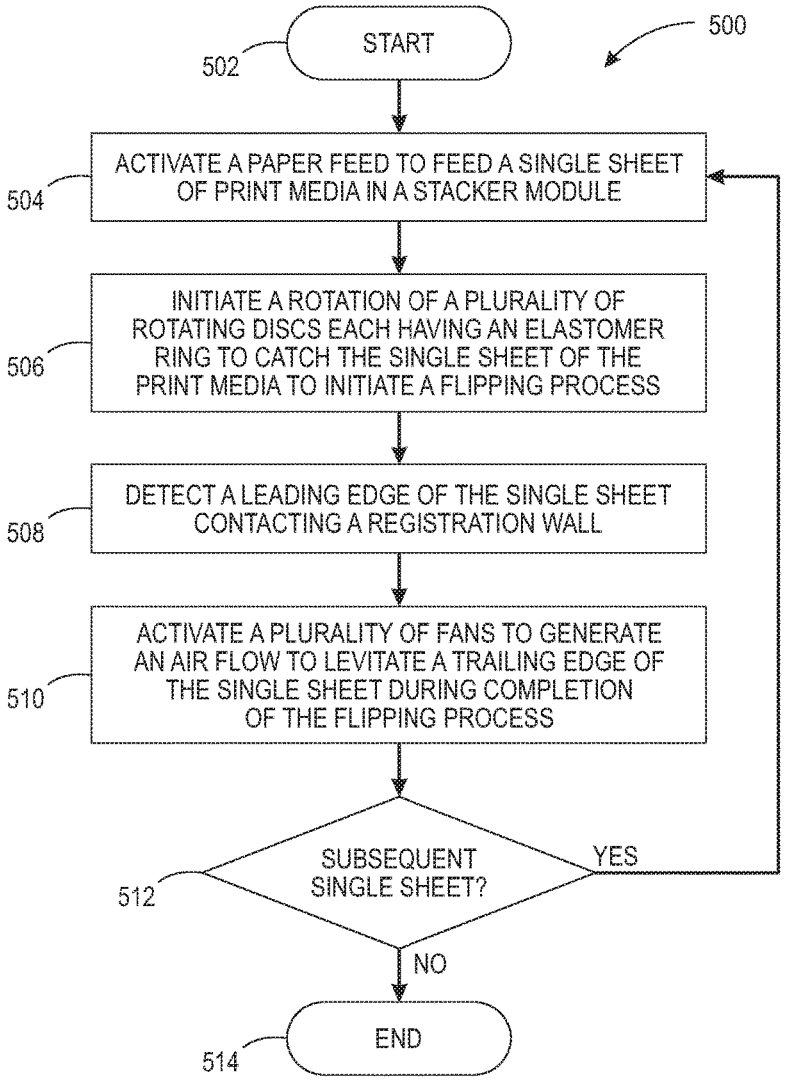
FIG. 5 illustrates a flowchart of an example method for flipping print media in a stacker module.
Figure 6:
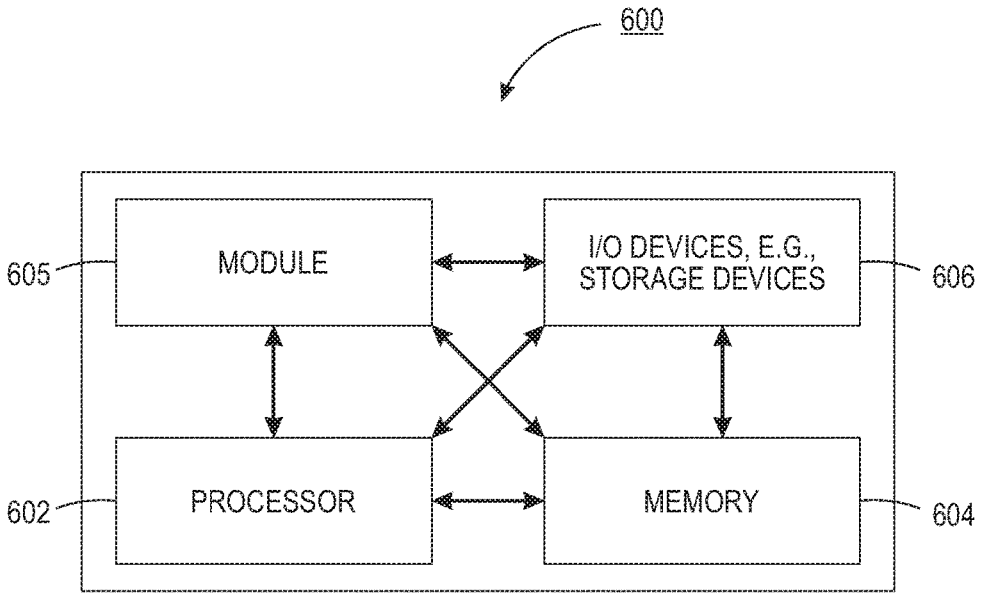
FIG. 6 illustrates a high-level block diagram of an example computer suitable for use in performing the functions described herein.

FIG. 5 illustrates a flowchart of an example method 500 for flipping print media in a stacker module. In one embodiment, one or more steps or operations of the method 500 may be performed by the stacker module 108 or a computer/processor that controls operation of the stacker module 108 as illustrated in FIG. 6 and discussed below.

At block 502, the method 500 begins. At block 504, the method 500 activates a paper feed to feed a single sheet of print media in a stacker module. For example, the paper feed may push the single sheet of print media down towards the stacker module to load the print media.

At block 506, the method 500 initiates a rotation of a plurality of rotating discs each having an elastomer ring to catch the single sheet of the print media to initiate a flipping process. For example, as the single sheet of print media is loaded into the stacker module, the elastomer ring on each disc may catch a leading edge of the single sheet of the print media. The elastomer ring may then pull the leading edge towards a registration wall.

At block 508, the method 500 detects a leading edge of the single sheet contacting a registration wall. For example, a sensor in the paper path of the stacker module may be used to calculate when the leading edge contacts the registration wall. For example, a distance between the sensor and the registration wall and a speed of the single sheet may be used to calculate when the leading edge of the single sheet contacts the registration wall. When the leading edge contacts the registration wall, the registration wall may signal a processor or controller that the single sheet is in position to begin the flipping process.

At block 510, the method 500 activates a plurality of fans to generate an air flow to levitate a trailing edge of the single sheet during completion of the flipping process. For example, in response to detecting that the leading edge of the single sheet is against the registration wall, the processor or controller may activate the plurality of fans. The fans may generate air flow that is evenly applied across a width of the single sheet to levitate a portion that is adjacent to the trailing edge. The levitation may assist the single sheet to complete the flipping process without collapsing on itself (e.g., the portion near the trailing edge collapsing on a portion near the leading edge without being completely flipped).

In one embodiment, the amount of air flow generated by the plurality of fans may be a function of a weight and/or length of the print media that is used. In one embodiment, for a single sheet of print media that has a weight of approximately 45 gsm and a length of 17 inches, the amount of air flow that is generated may be approximately 15-30 cubic feet per minute (cfm). In one embodiment, the amount of air flow generated by the fan may be approximately 25 cfm.

At block 512, the method 500 determines if there is a subsequent single sheet of print media. For example, if the stacker module has additional sheets of the print media to flip, the answer to block 512 is "yes" and the method returns to block 504. In one embodiment, before returning to block 504, the method 500 may move a movable platform that holds the single sheet lower to receive a subsequent single sheet of the print media. The movable platform may be lowered with each sheet of print media that is flipped and stacked on top of one another. The method 500 may then repeat blocks 504-512 until all of the print media has been flipped and the stacking of the print media is complete. However, it should be noted that the fans would remain active if blocks 504-512 are repeated to during completion of the flipping process.

If the answer to block 512 is "no" then the method may proceed to block 514. At block 514, the method 500 ends.

It should be noted that the blocks in FIG. 5 that recite a determining operation or involve a decision do not necessarily require that both branches of the determining operation be practiced. In other words, one of the branches of the determining operation can be deemed as an optional step. In addition, one or more steps, blocks, functions or operations of the above described method 500 may comprise optional steps, or can be combined, separated, and/or performed in a different order from that described above, without departing from the example embodiments of the present disclosure.

FIG. 6 depicts a high-level block diagram of a computer that is dedicated to perform the functions described herein. As depicted in FIG. 6, the computer 600 comprises one or more hardware processor elements 602 (e.g., a central processing unit (CPU), a microprocessor, or a multi-core processor), a memory 604, e.g., random access memory (RAM) and/or read only memory (ROM), a module 605 for flipping print media in a stacker module, and various input/output devices 606 (e.g., storage devices, including but not limited to, a tape drive, a floppy drive, a hard disk drive or a compact disk drive, a receiver, a transmitter, a speaker, a display, a speech synthesizer, an output port, an input port and a user input device (such as a keyboard, a keypad, a mouse, a microphone and the like)). Although only one processor element is shown, it should be noted that the computer may employ a plurality of processor elements. Furthermore, although only one computer is shown in the figure, if the method(s) as discussed above is implemented in a distributed or parallel manner for a particular illustrative example, i.e., the steps of the above method(s) or the entire method(s) are implemented across multiple or parallel computers, then the computer of this figure is intended to represent each of those multiple computers. Furthermore, one or more hardware processors can be utilized in supporting a virtualized or shared computing environment. The virtualized computing environment may support one or more virtual machines representing computers, servers, or other computing devices. In such virtualized virtual machines, hardware components such as hardware processors and computer-readable storage devices may be virtualized or logically represented.

It should be noted that the present disclosure can be implemented in software and/or in a combination of software and hardware, e.g., using application specific integrated circuits (ASIC), a programmable logic array (PLA), including a field-programmable gate array (FPGA), or a state machine deployed on a hardware device, a computer or any other hardware equivalents, e.g., computer readable instructions pertaining to the method(s) discussed above can be used to configure a hardware processor to perform the steps, functions and/or operations of the above disclosed methods. In one embodiment, instructions and data for the present module or process 605 for flipping print media in a stacker module (e.g., a software program comprising computer-executable instructions) can be loaded into memory 604 and executed by hardware processor element 602 to implement the steps, functions or operations as discussed above in connection with the example method 500. Furthermore, when a hardware processor executes instructions to perform "operations," this could include the hardware processor performing the operations directly and/or facilitating, directing, or cooperating with another hardware device or component (e.g., a co-processor and the like) to perform the operations.

The processor executing the computer readable or software instructions relating to the above described method(s) can be perceived as a programmed processor or a specialized processor. As such, the present module 605 for flipping print media in a stacker module (including associated data structures) of the present disclosure can be stored on a tangible or physical (broadly non-transitory) computer-readable storage device or medium, e.g., volatile memory, non-volatile memory, ROM memory, RAM memory, magnetic or optical drive, device or diskette and the like. More specifically, the computer-readable storage device may comprise any physical devices that provide the ability to store information such as data and/or instructions to be accessed by a processor or a computing device such as a computer or an application server.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus, comprising:

a paper feed to feed print media a single sheet at a time;

a sensor in a paper path to detect a leading edge of the single sheet contacting a registration wall;

a plurality of rotating discs, wherein each one of the plurality of rotating discs comprises an elastomer ring to secure the leading edge of the single sheet against the registration wall and initiate a flipping process;

a plurality of fans to generate an air flow, wherein the plurality of fans is activated in response to the leading edge of the single sheet contacting the registration wall, wherein the air flow levitates a trailing edge of the single sheet during completion of the flipping process;

a movable platform to hold a stack of the print media; and a vacuum to create a low pressure zone, wherein the vacuum is coupled to a first end of a stacker module that is opposite from a second end of the stacker module where the plurality of fans are located.

2. The apparatus of claim 1, further comprising:

a deflector coupled to each one of the plurality of fans to prevent the air flow from affecting an existing stack of the print media.

3. The apparatus of claim 2, wherein the deflector comprises a metal or a plastic.

4. The apparatus of claim 2, wherein the deflector is coupled to a bottom of the each one of the plurality of fans and angled away from the movable platform to move the air flow above the existing stack of the print media on the movable platform.

5. The apparatus of claim 1, wherein the plurality of fans comprises a first fan and a second fan that are positioned at opposite ends of the plurality of rotating discs and angled towards the single sheet in a "V" formation.

6. The apparatus of claim 1, wherein a length and a width of each one of the plurality of fans are smaller than a diameter of each one of the plurality of rotating discs.

7. The apparatus of claim 1, wherein an amount of the air flow comprises a range of approximately 15-30 cubic feet per minute (cfm).

8. The apparatus of claim 7, wherein the amount of the air flow comprises approximately 25 cfm.

9. The apparatus of claim 1, wherein the print media comprises paper having a weight of less than 50 grams per square meter (gsm) and a length of less than 20 inches.

10. A method for flipping print media in a stacker module, comprising:

activating, by a processor, a paper feed to feed a single sheet of the print media in a stacker module;

initiating, by the processor, a rotation of a plurality of rotating discs each having an elastomer ring to catch the single sheet of the print media to initiate a flipping process;

detecting, by the processor, a leading edge of the single sheet contacting a registration wall based on a signal from a sensor in a paper path, a speed of the single sheet and a distance between the sensor and the registration wall;

activating, by the processor, a plurality of fans in response to the detecting of the leading edge of the single sheet contacting the registration wall to generate an air flow to levitate a trailing edge of the single sheet during completion of the flipping process; and activating, by the processor, a vacuum to create a low pressure zone, wherein the vacuum is coupled to a first end of the stacker module that is opposite from a second end of the stacker module where the plurality of fans are located to create a low pressure zone.

11. The method of claim 10, further comprising:

moving, by the processor, a movable platform that holds the single sheet lower to receive a subsequent single sheet of the print media; and repeating, by the processor, the activating the paper feed, the initiating, the detecting, and the activating the plurality of fans for the subsequent single sheet of print media until stacking of the print media is complete.

12. The method of claim 11, wherein a deflector is coupled to each one of the plurality of fans to deflect the air flow above an existing stack of the print media on the movable platform.

13. The method of claim 10, wherein the plurality of fans comprises a first fan and a second fan that are positioned at opposite ends of the plurality of rotating discs and angled towards the single sheet in a "V" formation.

14. The method of claim 10, wherein an amount of the air flow is a function of a weight and a length of the single sheet of the print media that are provided by a user via a user input device.

15. The method of claim 14, wherein an amount of the air flow comprises a range of approximately 15-30 cubic feet per minute (cfm).

16. The method of claim 15, wherein the amount of the air flow comprises approximately 25 cfm.

17. The method of claim 14, wherein the weight comprises less than 50 grams per square meter (gsm) and the length comprises less than 20 inches.

18. An apparatus, comprising:

a paper feed to feed a single sheet of paper at a time, wherein the paper weighs less than 50 grams per square meter (gsm) and has a length of at least 19 inches;

a sensor in a paper path to detect a leading edge of the single sheet contacting a registration wall;

a plurality of rotating discs, wherein each one of the plurality of rotating discs comprises an elastomer ring, wherein the plurality of rotating discs secures the leading edge of the single sheet and rotates move the leading edge of the single sheet towards the registration wall and initiate a flipping process;

a first fan and a second fan to generate an amount of an air flow of approximately 15 cubic feet per minute (cfm) to 30 cfm towards an end that is opposite the plurality of rotating discs to levitate a trailing edge of the single sheet of paper during completion of the flipping process, wherein the first fan and the second fan are activated in response to the leading edge of the single sheet contacting the registration wall;

a movable platform to hold a stack of the print media, wherein the first fan and the second fan are located adjacent to the plurality of rotating discs at an angle towards a center of the single sheet of paper, above the movable platform, and below the paper feed; and a vacuum to create a low pressure zone, wherein the vacuum is coupled to a first end of a stacker module that is opposite from a second end of the stacker module where the first fan and the second fan are located.

* * * * *